US011839244B1

(12) United States Patent
Jorden

(10) Patent No.: US 11,839,244 B1
(45) Date of Patent: Dec. 12, 2023

(54) LEG MASSAGING TROUSER ASSEMBLY

(71) Applicant: Jeffery B. Jorden, Kankakee, IL (US)

(72) Inventor: Jeffery B. Jorden, Kankakee, IL (US)

( * ) Notice: Subject to any disclaimer, the term of this patent is extended or adjusted under 35 U.S.C. 154(b) by 0 days.

(21) Appl. No.: 18/220,547

(22) Filed: Jul. 11, 2023

(51) Int. Cl.
*A41D 1/06* (2006.01)
*A41D 27/20* (2006.01)

(52) U.S. Cl.
CPC ..... *A41D 1/06* (2013.01); *A41D 27/202* (2013.01); *A41D 2400/322* (2013.01)

(58) Field of Classification Search
CPC ..... A41D 1/06; A41D 27/202; A41D 27/205; A41D 2400/322; A41D 2400/14; A41D 2400/32
See application file for complete search history.

(56) References Cited

U.S. PATENT DOCUMENTS 1,378,870 A * 5/1921 Kauffman ..... A41D 13/065 2/24
2,869,537 A * 1/1959 Chu ..... A61H 9/0078 482/13
4,979,502 A * 12/1990 Hunt ..... A61H 23/02 601/79
5,787,505 A * 8/1998 Piwko ..... A41D 13/0058 2/247
6,421,839 B1 * 7/2002 Vo ..... A41D 13/065 2/24
7,950,067 B2 * 5/2011 Williams, Jr. ..... A41D 13/065 2/23
8,052,630 B2 11/2011 Kloecker et al.
8,418,267 B2 * 4/2013 Shaw ..... G06Q 99/00 40/586
8,726,421 B2 * 5/2014 Alvarez ..... A41D 13/0512 5/636
9,044,053 B1 * 6/2015 Osatchuck ..... A41D 13/0575
9,149,075 B2 * 10/2015 Kiker ..... A41B 15/02
9,655,391 B2 * 5/2017 Carver ..... A41D 13/065
9,861,144 B2 * 1/2018 Carver ..... A41D 13/065
10,143,251 B2 * 12/2018 Kiker ..... G06Q 90/00
10,306,939 B2 * 6/2019 Huang ..... A41D 1/06
10,441,743 B1 * 10/2019 McKamy ..... A41B 13/00
10,905,628 B2 * 2/2021 Hodges, IV ..... G16H 40/63
11,083,664 B2 8/2021 Vain et al.
11,266,190 B2 * 3/2022 Cleghorn ..... A41D 27/201
11,471,116 B2 * 10/2022 Tucker ..... A61H 9/0078
11,523,644 B2 * 12/2022 Hall ..... A41D 27/20
11,547,627 B2 * 1/2023 Merino ..... A61H 23/006
(Continued)

*Primary Examiner* — Alissa L Hoey
(74) *Attorney, Agent, or Firm* — Dale J. Ream

(57) ABSTRACT

A leg massaging trouser assembly treats leg pain while driving. The leg massaging trouser assembly includes trousers having a pair of leg portions. Each leg portion includes a pocket mounted to an inside leg surface and having an open end. Each leg defines a slit opening in communication with an interior of the pocket, each pocket configured to receive a therapeutic device operable to massage a driver's legs. Each leg includes an adjustment area having a plurality of fasteners adjacent each slit. An upper fastener, such as a flap, is coupled to the leg therapeutic device and is pivotally movable between an open configuration that allows insertion or removal of the leg therapeutic device from a pocket and a closed configuration attached along the adjustment area, which secures the leg therapeutic device and enables each leg to be cinched tightly or relaxed.

13 Claims, 9 Drawing Sheets

(56) References Cited

U.S. PATENT DOCUMENTS

| | | | | |
|---|---|---|---|---|
| 11,684,094 | B2 * | 6/2023 | Arnold | A41D 13/0055 2/102 |
| 2006/0015987 | A1 * | 1/2006 | Anderson | A41D 27/20 2/247 |
| 2007/0028349 | A1 * | 2/2007 | Watson | A41D 1/06 2/69 |
| 2007/0157356 | A1 * | 7/2007 | Jin | A41D 13/065 2/23 |
| 2007/0179416 | A1 * | 8/2007 | Obrien | A61H 9/0078 601/149 |
| 2011/0072565 | A1 * | 3/2011 | Krueger | A41D 13/0151 267/140.3 |
| 2012/0117713 | A1 * | 5/2012 | Hoffner | A41D 27/20 224/587 |
| 2014/0215679 | A1 * | 8/2014 | Habip | A41D 13/0506 2/23 |
| 2015/0359278 | A1 * | 12/2015 | Kiker | A41D 27/08 2/246 |
| 2017/0006934 | A1 * | 1/2017 | Miller | A41D 13/0575 |
| 2018/0228226 | A1 * | 8/2018 | Corcoran | A41D 31/18 |
| 2018/0360141 | A1 * | 12/2018 | Marchbanks | A41D 13/0575 |
| 2019/0060164 | A1 * | 2/2019 | Vo | A41D 13/0575 |
| 2019/0274382 | A1 * | 9/2019 | Omais | D05B 97/12 |
| 2020/0037675 | A1 * | 2/2020 | Schutz | A41D 1/067 |
| 2020/0188224 | A1 * | 6/2020 | Mountjoy | A61H 1/00 |
| 2020/0405531 | A1 * | 12/2020 | Juaire | A41D 1/06 |
| 2021/0045963 | A1 * | 2/2021 | Bravo | A61H 15/0085 |
| 2021/0059332 | A1 * | 3/2021 | Fernandez | A61H 23/0263 |
| 2022/0264971 | A1 * | 8/2022 | DeLara | A41D 13/1245 |
| 2022/0339058 | A1 * | 10/2022 | Schutzenhofer | A61H 9/0092 |

* cited by examiner

LEG MASSAGING TROUSER ASSEMBLY

BACKGROUND OF THE INVENTION

This application relates generally to air compression leg therapy and, more particularly, to a pair of trousers having removable pneumatic air compressive therapeutics for alleviating leg pain in drivers.

Drivers of automobiles and, more particularly, semi-truck drivers spend countless hours per day behind the wheel of an automobile. In fact, driving is an essential part of daily life for many individuals. Driving, however, can lead to various discomforts, including leg pain. Leg pain in drivers can arise due to factors such as reduced blood circulation, poor posture, muscle fatigue, and a limited ability to change positions with good frequency.

Specifically, sitting in a static position for extended periods of time may impede blood flow that causes reduced circulation in the legs. Insufficient blood flow can lead to leg cramps, muscle tension, and sensations of dull pain. Further, maintaining an improper posture while driving, such as slouching or sitting too close to the steering wheel in place excessive strain on leg muscles, resulting in discomfort and pain in addition, sitting continuously without the ability to stretch or operate one's legs can result in muscle stiffness and tension. This lack of movement can lead to the development of blood clots, which is a condition known as deep vein thrombosis (DVT).

Therefore, it would be desirable to have a leg massaging trouser assembly that include trousers wearable by a driver into which a plurality of leg massaging devices may be inserted and energize so as to alleviate the causes of leg pain drivers. Further, it would be desirable to have a leg massaging trouser assembly in which the leg massaging devices may be easily and slidably removed so that the trousers may be monitored like normal pants. In addition, it would be desirable to have a leg massaging trouser assembly that mitigates leg discomfort without hampering a truck driver's occupational viability by introducing air compression leg therapy while actually driving.

SUMMARY OF THE INVENTION

This invention is directed to a leg massaging trouser assembly to be worn by a driver of an automobile, such as by truck driver, that treats the causes of leg pain while actually driving the automobile. Specifically, the leg massaging trouser assembly may include a pair of trousers having a pair of leg portions extending downwardly from a waist portion in a traditional manner. Each leg portion may include a pocket mounted to respective inside surfaces and that defines an interior space and having an open end. Each leg portion of the trousers defines a slit opening in communication with the interior space of the pocket, each pocket being configured to receive a leg therapeutic device that is operable to massage a driver's legs when energized.

Each leg of the trousers includes an adjustment area adjacent each slit includes fasteners. An upper fastener, such as a flap, is coupled to an end of the leg therapeutic device and is pivotally movable between an open configuration that allows the leg therapeutic device to be inserted or removed from a pocket and a closed configuration securely attached along the adjustment area. The fasteners may be hook and loop fasteners and configured to enable each leg portion to be cinched tightly or relaxed.

Therefore, a general object of this invention is to provide a leg massaging trouser assembly having a pair of trousers, such as jeans, that are particularly adapted to provide truck drivers with air compression therapy to alleviate leg pain that is often experienced from a lifetime sitting behind the wheel.

Another object of this invention is to provide a leg massaging trouser assembly, as aforesaid, configured to receive a plurality of pneumatic air compression devices into the trousers while actually driving and which are easily removed so that the trousers may be laundered by traditional pants.

Still another object of this invention is to provide a leg massaging trouser assembly, as aforesaid, that include fasteners that may be manipulated to tighten or loosen a diameter of each leg portion of the trousers.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
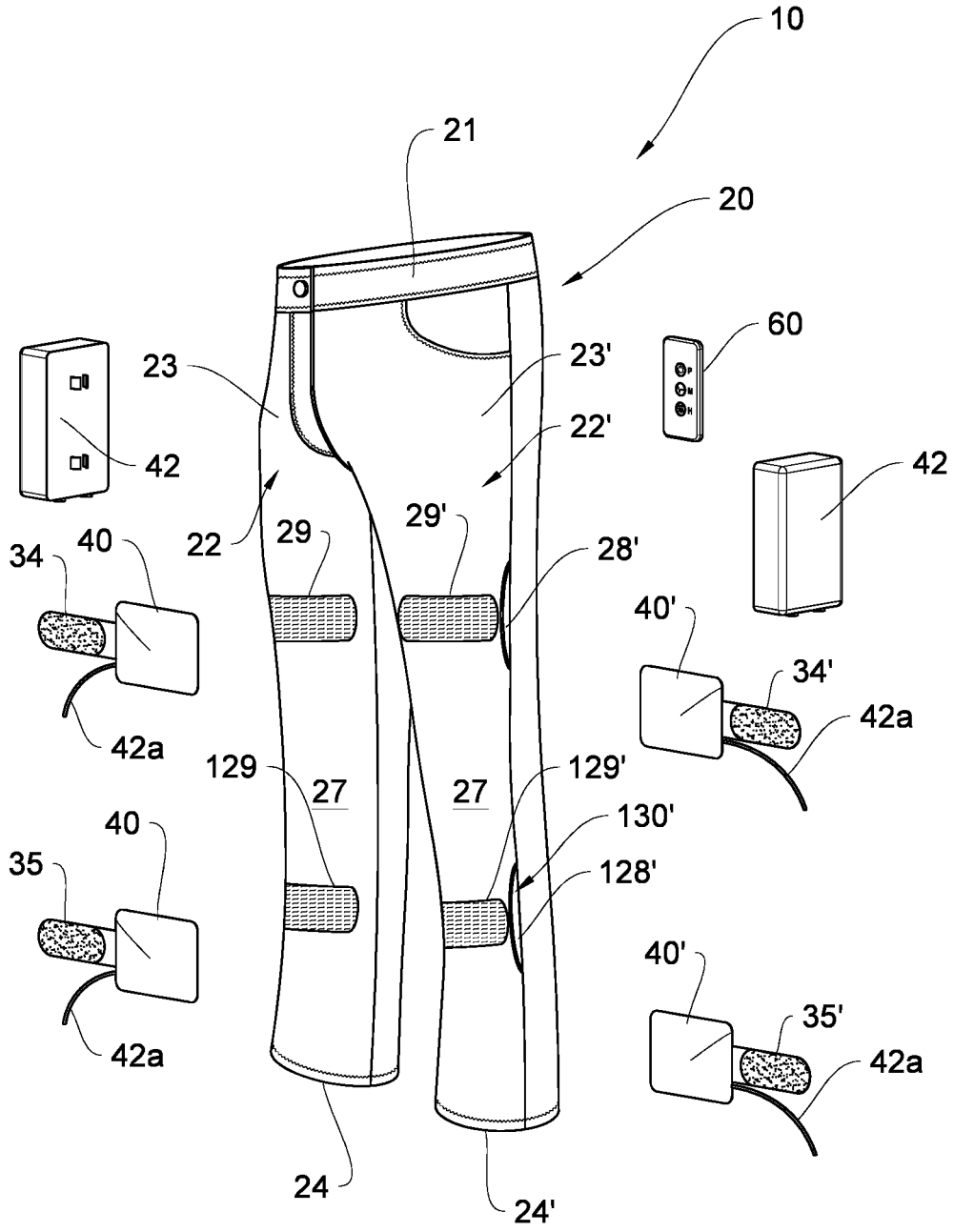
FIG. 1 is an exploded perspective view of a leg massaging trouser assembly according to a preferred embodiment of the present invention.
Figure 2:
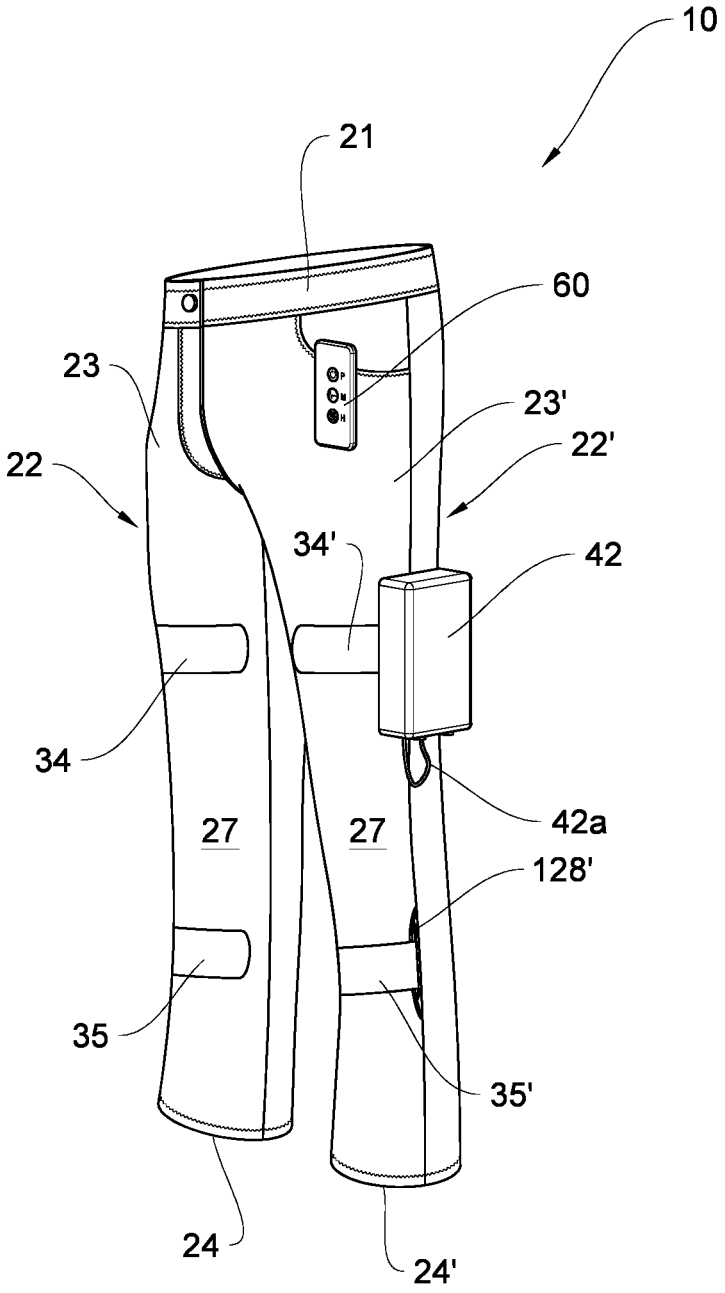
FIG. 2 is a perspective view of the leg massaging trouser assembly, illustrated in a fully assembled configuration.
Figure 3:
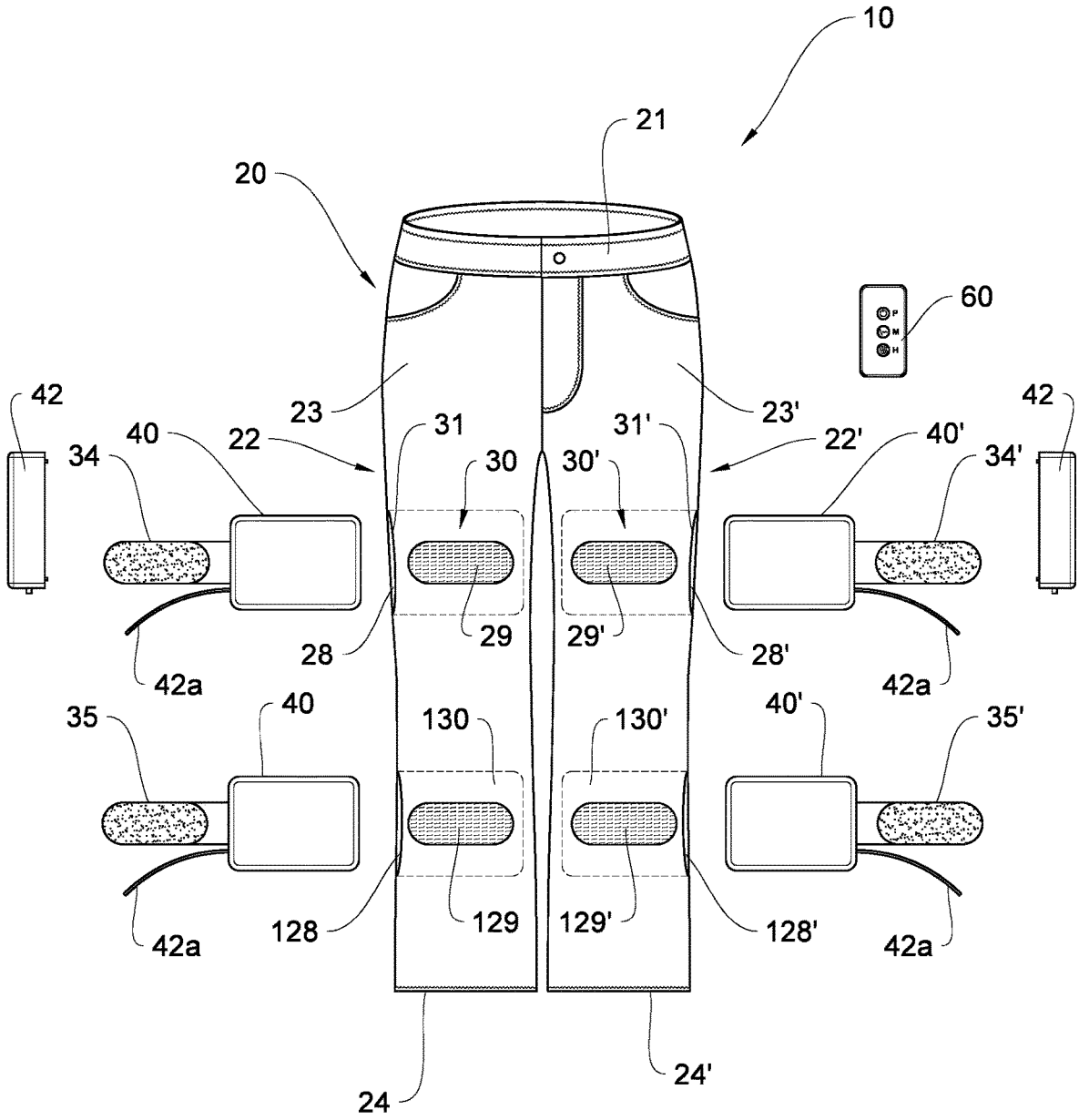
FIG. 3 is a front view of the leg massaging trouser assembly as in FIG. 1, illustrated prior to insertion of a leg massaging device.

A leg massaging trouser assembly according to a preferred embodiment of the present invention will now be described with reference to the accompanying drawings. The leg massaging trouser assembly 10 includes trousers 20 having a pair of leg portions 22, 22', a pair of pockets 30, 30', at least a pair of leg therapeutic devices 40, 40', and a pair of flaps 50, 50'. Primed reference characters will be utilized to identify left side and right side elements that are otherwise identical in construction.

First, the leg massaging trouser assembly 10 includes a pair of trousers 20 that, in many respects, appear to be traditional trousers, such as a pair of jeans. The trousers, however, are uniquely configured to enable air compression technology to drivers while in the very act of driving and easily removed when not driving. More particularly, the trousers 20 may include a waist portion 21 and a pair of leg portions 22, 22' extending away from the waist portion 21, each leg portion being identical to the other and defining an interior area having a predetermined diameter in the manner of traditional sizing. Means for tightening or loosening that predetermined diameter will be discussed later. For clarity in describing preferred locations of various elements of the invention, each leg portion includes a proximal end 23, 23' adjacent the waist portion 21 corresponding generally to an upper leg area of a wearer of the trousers 20 and a distal end 24, 24' opposite the proximal end and corresponding generally to a lower leg area of a wearer of the trousers 20.

In a traditional construction, each leg portion 22, 22' has an inner surface and an outer surface 27. In an embodiment, each leg portion 22, 22' defines a slit 28, 28' along an outer leg seam that provides an opening for accessing the interior space defined by each leg portion. For instance, a section of a traditional outside leg seam of the trousers may omit the usual threading so as to separate or, alternatively, an outer panel of respective leg portions 22, 22' may define a cutout operable as an opening into the interior of each leg portion.

Further, a pocket 30, 30' is mounted to the inner surface of each leg portion 22, 22', respectively, at a location immediately laterally adjacent s respective slit 28, 28', such as by sewing. Preferably, each pocket 30, 30' is sewn shut on 3 sides so as to define an interior space but remains open (unsewn) on one end 31, 31' (i.e., the "open end") immediately adjacent a respective slit 28, 28'. In a preferred embodiment, therefore, a respective slit 28, 28' is in operable communication with a corresponding open end 31, 31' such that a leg therapeutic device 40, 40' may be inserted into a corresponding interior space of a corresponding pocket 30, 30'. It is understood that the structures described above are illustrated proximate the proximal end 23, 23' of the trousers 20 and that similar structures related to auxiliary or additional structures will be described later.

The leg massaging trouser assembly 10 includes a plurality of therapeutic devices each configured to provide relief from pain and discomfort often experienced by long-distance and career drivers. These devices may be referred to generally as leg therapeutic devices 40, 40'. In an embodiment, each leg therapeutic device is a pneumatic air compression device that is operable when air is provided from a pump and when energized by electrical current from a wall outlet or a battery. More particularly, each leg therapeutic device 40, 40' includes an inflatable air bag that may be connected to and in fluid communication with an air pump 42 as well as being in electrical communication with a controller 60. In use, the airbag or pressure cuff fills with air and squeezes or puts pressure on the leg, much like a blood pressure cuff. Then the cuff deflates and relaxes. The process then repeats over and over so as to improve blood circulation.

The controller 60 is an electronics housing that may include input buttons enabling a user to energize the leg therapeutic device, control operation of the leg therapeutic device such as intermittent versus continuous actuation, to activate a light, and the like. It is understood that the controller 60 may be electrically connected to each leg therapeutic device with wires or wirelessly.

Figure 8:
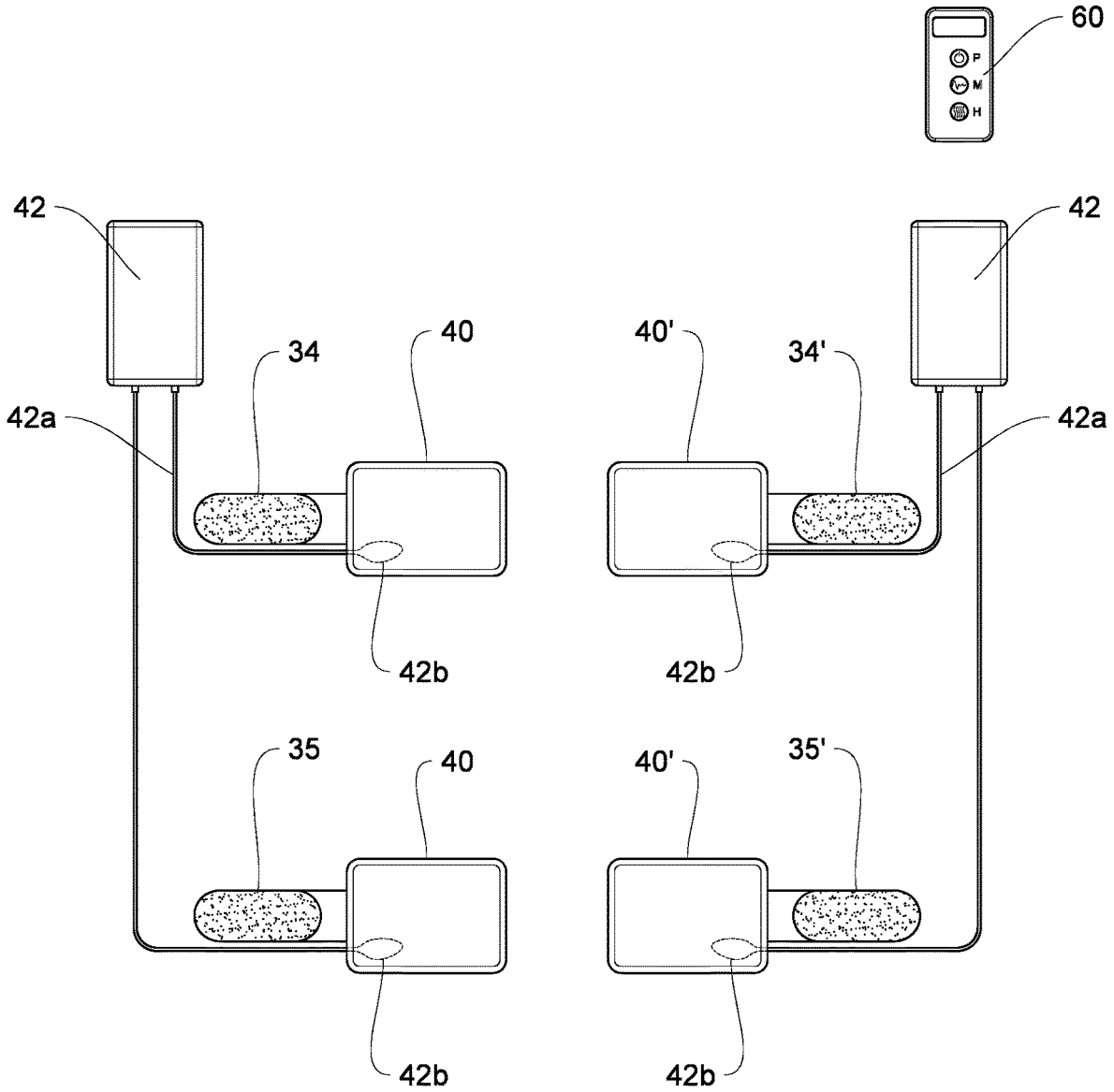
FIG. 8 is a front view of the leg massaging trouser assembly with the trousers removed, illustrating the leg massaging devices being inflated.
Figure 9:
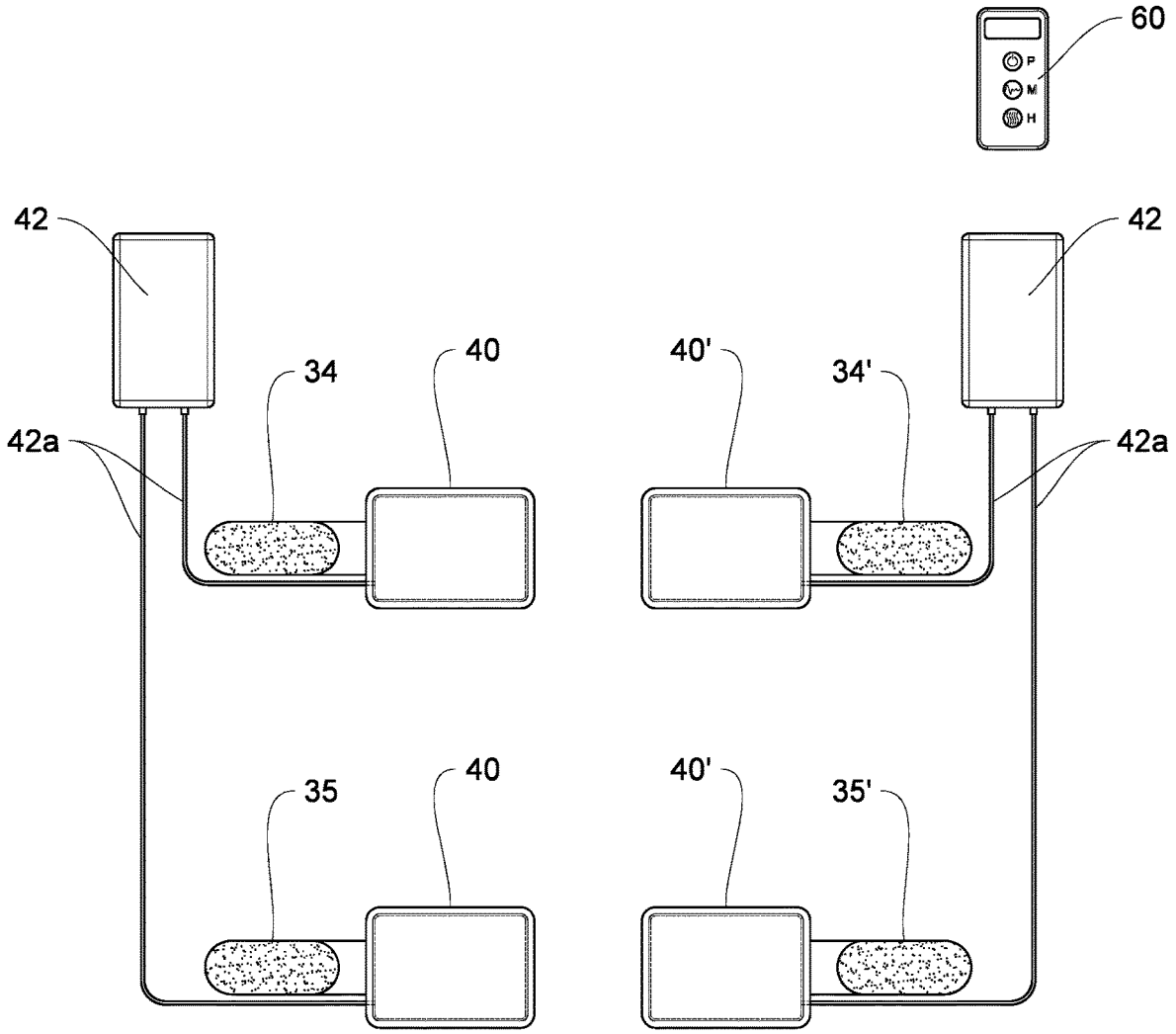
FIG. 9 is another front view of the leg massaging trouser assembly as an FIG. 8, illustrating fully inflated leg massaging devices.

As shown particularly in FIGS. 8 and 9, each leg therapeutic device 40, 40' may be connected to a corresponding air pump 42 via tubing 42*a* capable of channeling air generated from the pump 42 to the air bag (in the manner of an air compressor). It is also understood that an air pump 42 may be carried or hung from an outer or exterior surface of the trousers 20 and a single pump 42 may be capable of channeling air to more than one leg therapeutic device 40, 40'—such as one pump on the left side and another on the right side. In an embodiment, the trousers 20 may include fasteners such as hooks, loops, rings, snaps, or the like on which to hang or attach an air pump.

Figure 4:
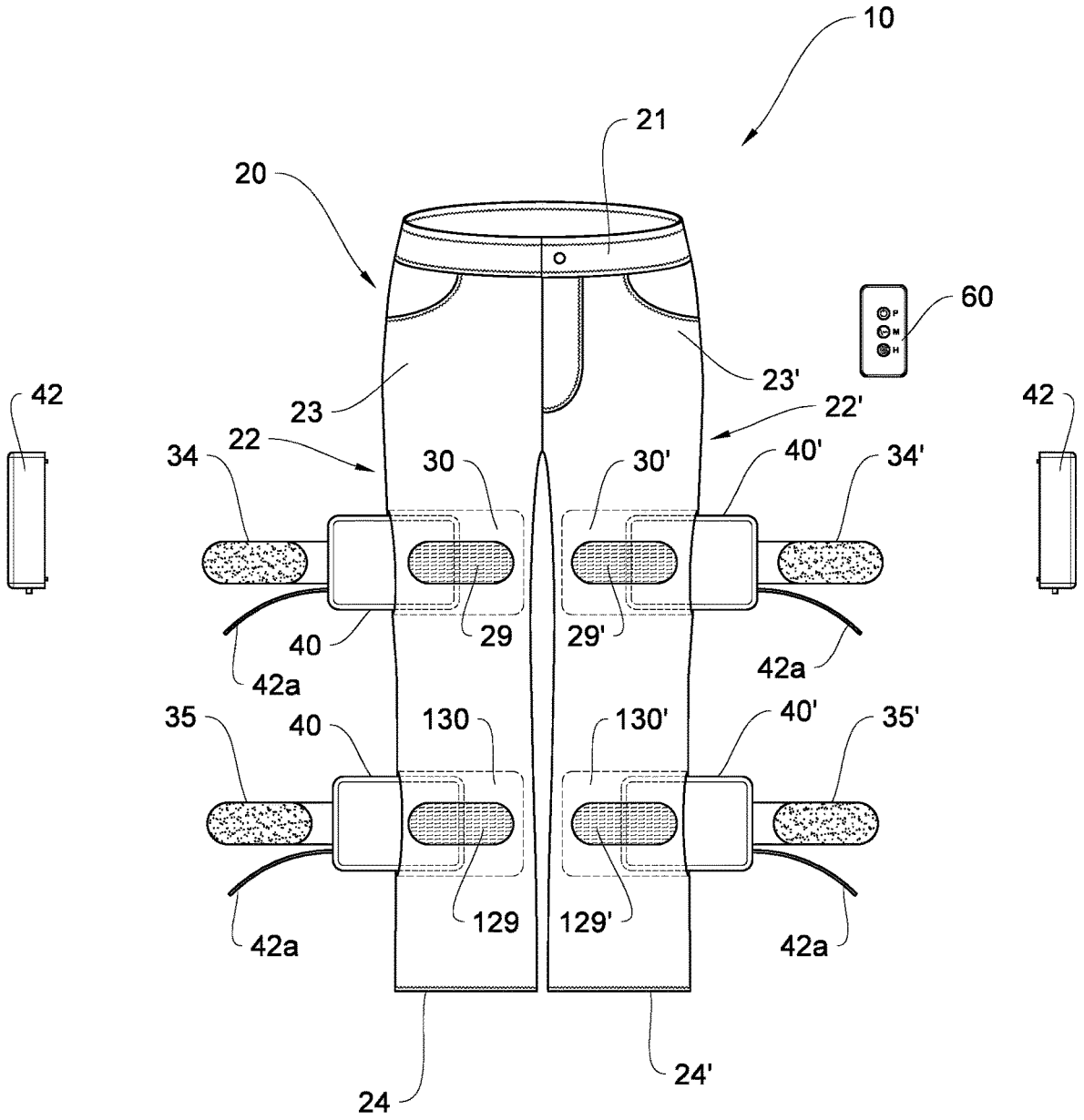
FIG. 4 is a front view of the leg massaging trouser assembly as in FIG. 3, illustrated in a first partial insertion configuration.
Figure 5:
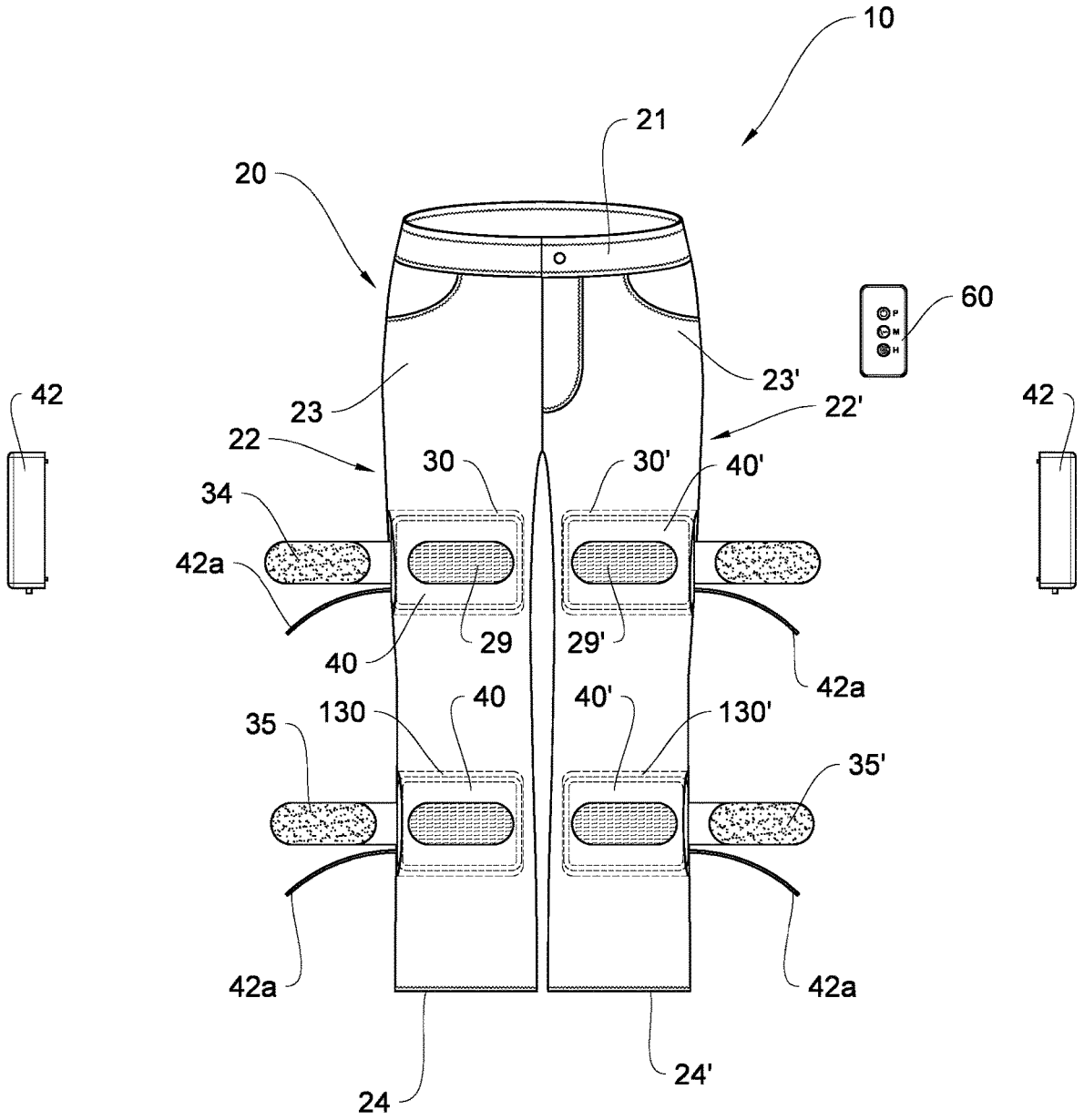
FIG. 5 is a front view of the leg massaging trouser assembly as in FIG. 4, illustrated in a full insertion configuration.
Figure 6:
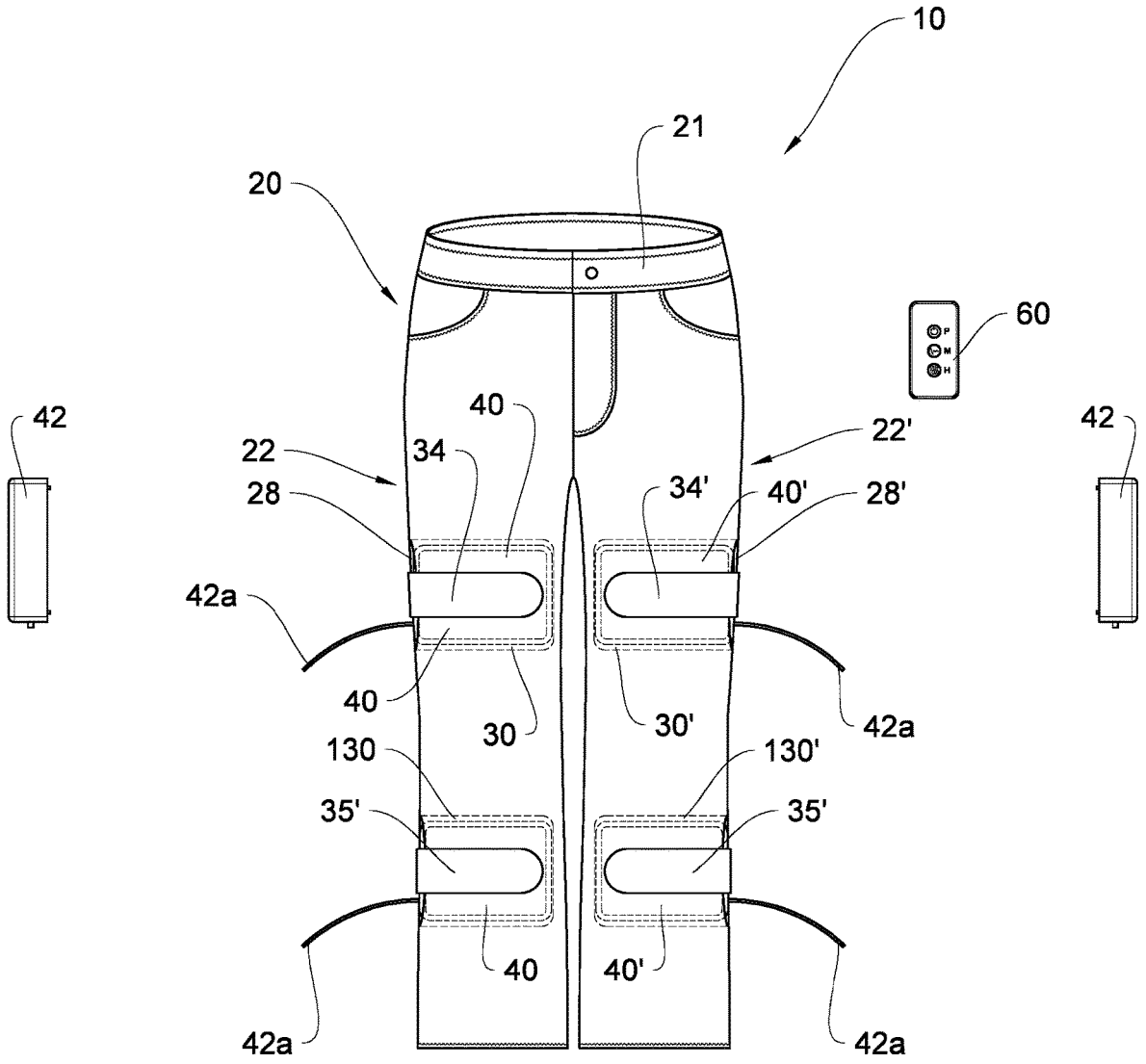
FIG. 6 is a front view of the leg massaging trouser assembly as in FIG. 4, illustrated with the leg adjustment flaps pivoted and attached.
Figure 7:
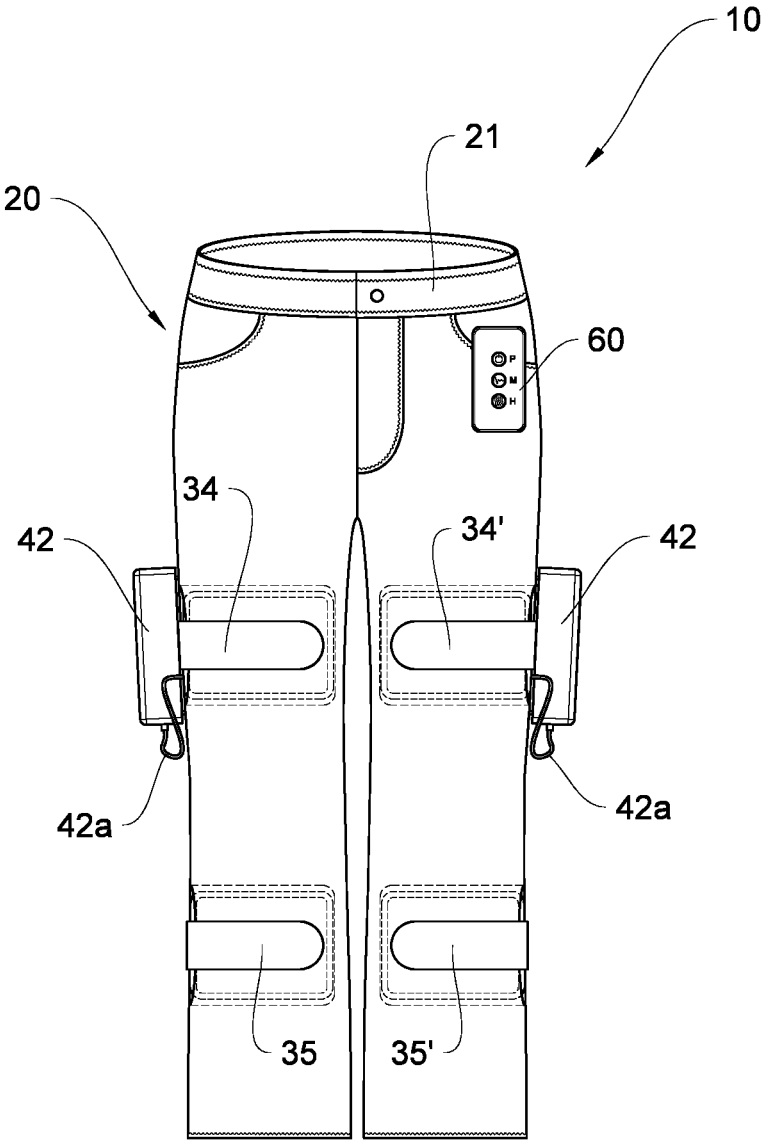
FIG. 7 is a front view of the leg massaging trouser assembly as in FIG. 6, illustrated in a fully assembled configuration.

The leg massaging trouser assembly 10 includes means for securing each leg therapeutic device 40, 40' into a corresponding pocket 30, 30' or for removing the same. An upper fastener 34, 34' provides an interface for securing a leg therapeutic device 40, 40' to the trousers 20. More particularly, the upper fastener 34, 34' may have a fabric construction having opposed ends in a semi-flexible construction. A first end thereof may be fixedly attached to a leg therapeutic device and, preferably, has a length such that a second end extends outwardly through a respective slit 28, 28' when the leg therapeutic device 40, 40' has been inserted fully into a respective pocket 30, 30'. Preferably, attachment of the first end defines a pivot point for the upper fastener 34, 34' to be pivotally movable between an open configuration (FIG. 4) extending away from a corresponding leg portion such that said leg therapeutic device is slidable into said pocket (as described above) and a closed configuration (FIG. 6) coupled to an exterior/outer surface of a corresponding leg portion 22, 22' such that said leg therapeutic device 40, 40' is secured in the respective pocket. In other words, the upper fastener 34, 34' may be opened to enable a leg therapeutic device 40, 40' to be freely inserted or removed from the corresponding pocket or may be closed (such as after a leg therapeutic device has been fully inserted) such that its second end may be coupled to the outer surface of a leg portion 22, 22'. In an embodiment, both the upper fastener 34, 34' and an area on each leg portion include complementary fasteners operable to secure a leg therapeutic device 40, 40' in a corresponding pocket as will be described in more detail below. Various fasteners may be utilized for securing a leg therapeutic device to the exterior surface of the trousers 20 such as snaps, clasps, hooks, threaded fasteners, and the like. A preferred fastener, however, is complementary hook and loop fasteners that are almost infinitely and incrementally adjustable so as to tighten or loosen the securement of a leg therapeutic device and of the diameter of each leg portion as described below.

In an embodiment, the upper fastener 34, 34' may be a flap constructed of plastic or thin plastic material and having a semi-flexible construction. The flap provides convenience during storage or nonuse in that it may be rolled up or encircled about the airbag of the therapeutic device itself. A flap is also convenient to flip open during insertion or removal of a leg therapeutic device and to flip closed so as to become attached to the outer surface of a leg portion 22, 22' of the trousers 20. More particularly, the flap may include an inner surface having one of a hook and loop material distributed thereon (e.g., hook fasteners). Further, each leg portion 22, 22' may include an adjustment area 29, 29' adjacent a respective slit 28, 28' and that includes another of a hook and loop material (e.g., loop fasteners) such that said inner surface of said flap is capable of attachment to a selected point along said adjustment area 29, 29'.

Usage of a flap fastener having one of a hook and loop material in cooperation with an adjustment area having another of a hook and loop material enables adjustment of the diameter of each leg portion 22, 22' of the trousers 20. In other words, each leg portion may be incrementally tightened or loosened to fit leg sizes of a driver or as may be preferred by the driver. More particularly, a leg portion may be incrementally tightened by stretching the flap further inwardly toward a central gap between the leg portions before coupling the flap to the corresponding adjustment area 29, 29'. Further, a user may prefer to tighten the airbags of a corresponding leg therapeutic device 40, 40' against his legs more than another user, or vice versa.

In an embodiment, at least one leg therapeutic device 40, 40' is positioned in a lower region of the interior space defined by the leg portions 22, 22' such that the calf muscles of a driver may also receive air compression therapy. Preferably, all of the structures described above in relation to an upper extent of the trousers 20 are identical or substantially similar when incorporated in a lower extent. For instance, auxiliary slits 128, 128' are defined by each leg portion 22, 22' in the region of the distal ends 24, 24'. Similarly auxiliary pockets 130, 130' may be mounted and sown in to an inner surface of each leg portion 22, 22' each having an open end proximate the auxiliary slits 128, 128' whereby another leg therapeutic device 40, 40' may be inserted in a manner substantially similar to that described previously. In addition, a lower fastener 35, 35' in the form of a lower flap may be attached at one end to the leg therapeutic device 40, 40' for pivotal movement between open and closed configurations, the leg therapeutic device being secured within a corresponding pocket when the lower flap is in the closed configuration and attached to a corresponding auxiliary adjustment area 129, 129' using corresponding hook and loop fasteners as described above. In the present application, it is understood that the word "auxiliary" may also be referred to as being "secondary" or using similar language.

FIGS. 8 and 9 illustrate how the massage devices 40 are actuated. Each massage device 40, 40' includes a bladder or a balloon that is inflated when a corresponding pump 42 is energized. More particularly, FIG. 8 illustrates that the tubing 42*a* includes a nozzle 42*b* operable to communicate air from a corresponding pump 42 into a respective bladder so as to impart compression on the legs of a user. FIG. Special 9 illustrates each bladder being fully filled with air.

In use, the leg massaging trouser assembly 10 enables a career driver (such as a semi-truck driver) to receive the benefits of air compression leg therapy while actually driving, the leg therapeutic devices being removably inserted into or removed from what appear to be an ordinary pair of trousers, such as specially accommodated jeans that may be laundered in due course.

It is understood that while certain forms of this invention have been illustrated and described, it is not limited thereto except insofar as such limitations are included in the following claims and allowable functional equivalents thereof.

The invention claimed is:

1. A leg massaging trouser assembly to be worn by a driver of an automobile, comprising:

trousers having a waist portion and a pair of leg portions extending downwardly from said waist portion each leg portion defining an interior area having an inner diameter, each said leg portion having a proximal end adjacent said waist portion and a distal end opposite said proximal end and arranged such that said trousers are configured to be worn as a lower body garment;

a pocket mounted to an inside surface of each said leg portion that defines an interior space and an open end in communication with said interior space;

wherein each said leg portion defines a slit proximate said proximal end that is in communication with said open end of each pocket, respectively;

a leg therapeutic device slidably received in the interior space of each pocket, respectively, that is operable to massage a user's legs when energized; and an upper fastener coupled to each said leg therapeutic device that is selectively movable between (1) an open configuration extending away from a corresponding leg portion such that said leg therapeutic device is slidable into said pocket and (2) a closed configuration coupled to said corresponding leg portion such that said leg therapeutic device is secured in said pocket;

wherein:

said upper fastener is a flap having a pivot point about which said upper fastener is pivotally movable between said open and closed configurations;

said flap has an inner surface having one of a hook and loop material;

each said leg portion includes an adjustment area adjacent a respective slit and that includes another of a hook and loop material such that said inner surface of said flap is capable of attachment to a selected point along said adjustment area so as to incrementally increase or decrease the inner diameter of a respective leg portion.

2. The leg massaging assembly as in claim 1, wherein said leg therapeutic device is selectively releasable from said trousers when said upper fastener is in said open configuration, respectively.

3. The leg massaging assembly as in claim 1, wherein:

said leg therapeutic device is slidable in a respective pocket when said upper fastener is in said open configuration; and said leg therapeutic device is unmovable in said respective pocket when said upper fastener is in said closed configuration.

4. The leg massaging assembly as in claim 1, wherein said leg therapeutic device is a pneumatic air compression device.

5. The leg massaging assembly as in claim 1, further comprising an air pump in fluid communication with a leg therapeutic device, respectively.

6. The leg massaging assembly as in claim 5, further comprising a controller in electrical communication with said leg therapeutic device, said controller being configured to energize said leg therapeutic device.

7. A leg massaging assembly to be worn by a driver of an automobile, comprising:

trousers having a waist portion and a pair of leg portions extending downwardly from said waist portion each leg portion defining an interior area having an inner diameter, each said leg portion having a proximal end adjacent said waist portion and a distal end opposite said proximal end and arranged such that said trousers are configured to be worn as a lower body garment;

a pocket mounted to an inside surface of each said leg portion that defines an interior space and an open end in communication with said interior space;

wherein each said leg portion defines a slit proximate said proximal end that is in communication with said open end of each pocket, respectively;

a leg therapeutic device slidably received in the interior space of each pocket, respectively, that is operable to massage a user's legs when energized; and an upper fastener coupled to each said leg therapeutic device that is selectively movable between (1) an open configuration extending away from a corresponding leg portion such that said leg therapeutic device is slidable into said pocket and (2) a closed configuration coupled to said corresponding leg portion such that said leg therapeutic device is secured in said pocket:

wherein:

each said leg portion defines an auxiliary slit proximate said distal end, respectively;

each said leg portion includes an auxiliary pocket coupled to the interior surface of each said leg portion proximate to the distal end and that defines an interior space and an open end, said auxiliary pocket being configured to receive a respective leg therapeutic device via said open end;

said leg massaging assembly includes a lower fastener coupled to the respective leg therapeutic device and that is pivotally movable between an open configuration extending away from a corresponding leg portion such that said leg therapeutic device is slidable in said auxiliary pocket and a closed configuration coupled to said corresponding leg portion such that said respective leg therapeutic device is secured in said auxiliary pocket wherein:

said lower fastener is a lower flap having a pivot point about which said lower flap is pivotally movable between said open and closed configurations;

said lower flap has an inner surface having one of a hook and loop material;

each said leg portion includes an auxiliary adjustment area adjacent a respective auxiliary slit and that includes another of a hook and loop material such that said inner surface of said lower flap is capable of attachment to a selected point along said auxiliary adjustment area so as to incrementally increase or decrease the inner diameter of a respective leg portion.

8. A leg massaging trouser assembly to be worn by a driver of an automobile, comprising:

trousers having a waist portion and a pair of leg portions extending downwardly from said waist portion each leg portion defining an interior area having an inner diameter, each said leg portion having a proximal end adjacent said waist portion and a distal end opposite said proximal end and arranged such that said trousers are configured to be worn as a lower body garment;

a pocket mounted to an inside surface of each said leg portion that defines an interior space and an open end in communication with said interior space;

wherein each said leg portion defines a slit proximate said proximal end that is in communication with said open end of each pocket, respectively;

a leg therapeutic device slidably received through a respective slit and a respective open end into the interior space of each pocket, respectively, that is operable to massage a user's legs when energized;

wherein said leg therapeutic device is a pneumatic air compression device;

a flap having a first end coupled to each said leg therapeutic device and a second end opposite said first end, said flap being pivotally movable between (1) an open configuration in which said second end extends away from a corresponding leg portion such that said leg therapeutic device is slidable into said pocket and (2) a closed configuration in which said second end is coupled to said corresponding leg portion such that said leg therapeutic device is secured in said pocket wherein said flap defines a pivot point about which said flap is pivotally movable between said open and closed configurations;

wherein:

said flap has an inner surface having one of a hook and loop material; and each said leg portion includes an adjustment area adjacent a respective slit and that includes another of a hook and loop material such that said inner surface of said flap is capable of attachment to a selected point along said adjustment area so as to incrementally increase or decrease the inner diameter of a respective leg portion.

9. The leg massaging assembly as in claim 8, further comprising a controller in electrical communication with said leg therapeutic device, said controller being configured to energize said leg therapeutic device.

10. The leg massaging assembly as in claim 8, further comprising an air pump in fluid communication with a respective leg therapeutic device via an air tube, respectively.

11. The leg massaging assembly as in claim 10, wherein each said leg portion of said trousers includes a fastener adapted to selectively receive the respective air pump.

12. The leg massaging assembly as in claim 8, wherein:

each said leg portion defines an auxiliary slit proximate said distal end, respectively;

each said leg portion includes an auxiliary pocket coupled to the interior surface of each said leg portion proximate to the distal end and that defines an interior space and an open end, said auxiliary pocket being configured to receive a respective leg therapeutic device via a corresponding open end;

said leg massaging assembly includes a lower flap coupled to the respective leg therapeutic device and that is pivotally movable between (1) an open configuration extending away from a corresponding leg portion and that allows said respective leg therapeutic device to slide into said auxiliary pocket and (2) a closed configuration coupled to said corresponding leg portion so that said respective leg therapeutic device is secured in said auxiliary pocket.

13. The leg massaging assembly as in claim 12, wherein:

said lower flap includes a pivot point about which said lower flap is pivotally movable between said open and closed configurations;

said lower flap has an inner surface having one of a hook and loop material;

each said leg portion includes an auxiliary adjustment area adjacent a respective auxiliary slit and that includes another of a hook and loop material such that said inner surface of said lower flap is capable of attachment along said auxiliary adjustment area so as to incrementally increase or decrease the inner diameter of a respective leg portion.

* * * * *